United States Patent [19]

Higgs

[11] 4,195,380

[45] Apr. 1, 1980

[54] LIFE SAVING APPARATUS FOR VESSELS

[75] Inventor: William Y. Higgs, Gibsons, Canada

[73] Assignee: Intercontinental Marine Limited, Canada

[21] Appl. No.: 810,684

[22] Filed: Jun. 27, 1977

[30] Foreign Application Priority Data

Aug. 31, 1976 [GB] United Kingdom ..... 36013/76
Oct. 6, 1976 [NO] Norway ..... 763413

[51] Int. Cl.[2] ..... B63B 21/52
[52] U.S. Cl. ..... 9/9
[58] Field of Search ..... 9/8 R, 9, 8.3 R, 8.3 E, 9/14; 114/51, 54, 254, 268, 270; 242/118.3, 118.8, 146, 77, 85, 100, 137.1; 254/150 R, 175.7, 187.2; 206/389–414; 116/124 B

[56] References Cited

U.S. PATENT DOCUMENTS

| | | | |
|---|---|---|---|
| 1,195,317 | 8/1916 | Woods | 9/9 |
| 1,384,412 | 7/1921 | Stoltz | 114/51 |
| 1,663,412 | 3/1928 | Mathews | 114/51 |
| 2,716,758 | 9/1955 | Hajecate | 9/8 R |
| 3,308,937 | 3/1967 | Rosen | 206/398 |
| 3,592,157 | 7/1971 | Schwartz | 116/124 B |
| 3,618,150 | 11/1971 | Anselmi | 9/8.3 E |
| 3,940,814 | 3/1976 | Bayles et al. | 9/9 |

*Primary Examiner*—Edward R. Kazenske
*Assistant Examiner*—Jesus D. Sotelo
*Attorney, Agent, or Firm*—Stevens, Davis, Miller & Mosher

[57] ABSTRACT

A life saving buoy of the type intended to float off the deck of a sinking vessel and to remain anchored to the vessel by an anchoring cable, to provide a mooring for life boats or life rafts and to give signals to aid rescurers; having improved structural features particularly in relation to the casing which carries the anchoring cable reel. The cable reel flanges are buried in the sides of the casing, with the gap between the flanges and casing being too small for cable to become snagged therein. The reel casing is also made readily removable for servicing. The reel compartment is closed by a bottom plate having an aperture which serves as a guide for the cable.

4 Claims, 5 Drawing Figures

LIFE SAVING APPARATUS FOR VESSELS

Figures 1, 1A, 2, 3, 4:
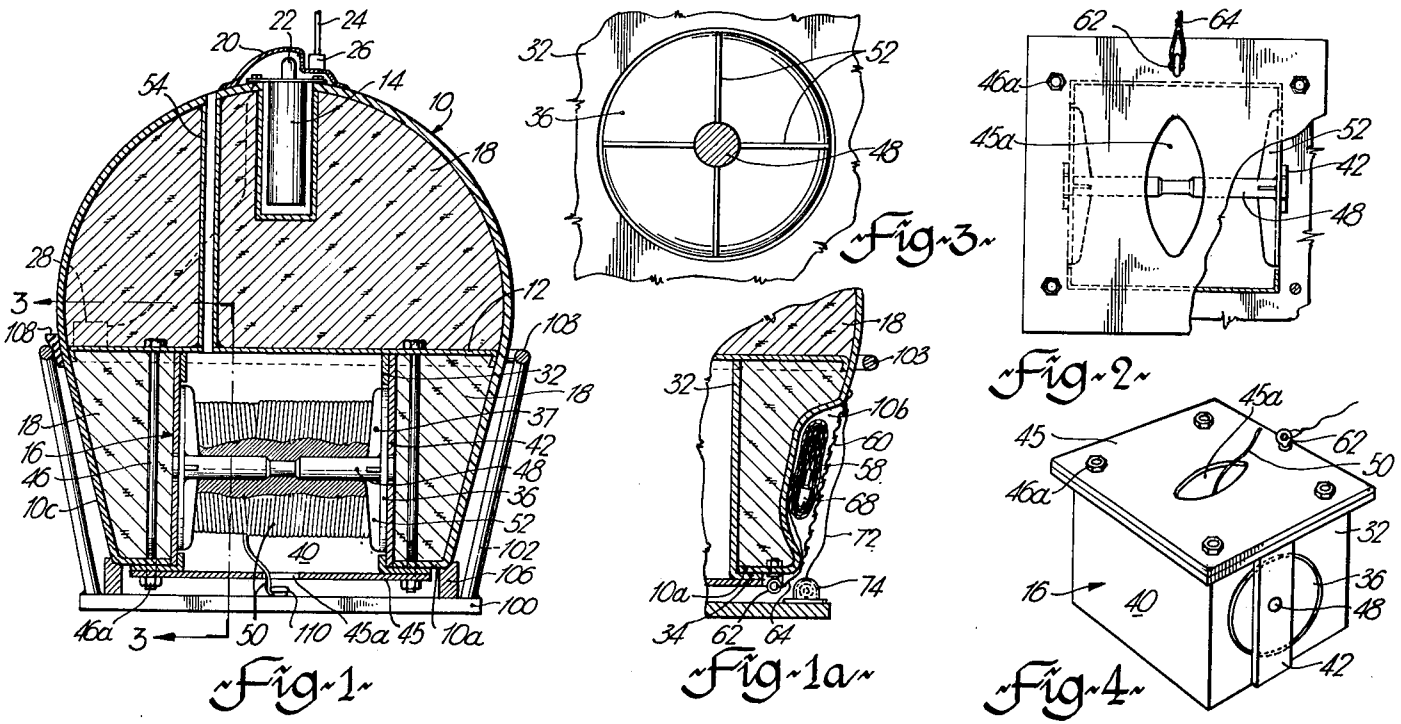

This invention relates to life-saving apparatus for vessels, and particularly to improvements in the inventions described in my British Patent Specification No. 1416048 published Dec. 3, 1975. This patent is concerned with a buoy of the type suitable for being carried by a vessel in a manner permitting release and floatation of the buoy should the vessel sink, said buoy including a body having sufficient buoyancy to cause the buoy and parts carried thereby to float free from the sinking vessel, and cable of adequate strength to act as an anchoring cable initially carried by a reel rotatably mounted within the buoy, the anchoring cable being connected with the buoy and for connection with the vessel so as to maintain connection between the floating buoy and the vessel after this has sunk. A buoy of this type will hereinafter be referred to as being "of the type described."

The buoys described in the aforesaid patent include both light and radio beacons which automatically give distress signals when the buoy is floating in the water. Also, a particular feature of the aforesaid patent was the use of a buoyant mooring line which is relatively long compared to the dimensions of the buoy and which is normally stowed on the buoy, but which is released automatically when the buoy separates from the vessel to stream out on the water and to provide mooring means for buoyant equipment such as life-boats, life-rafts, etc. released from the vessel. The buoyant equipment held in this way remains in marshalled condition in the vicinity of the sunken vessel and can easily be located by the beacons described, and this arrangement provides the further advantage that the buoyant equipment stays head-on to the wind and sea so that the risk of upset is minimized.

The present invention provides modifications of the buoys described in the aforesaid patent which render the buoy inexpensive to manufacture, sturdy, easy to maintain, and trouble-free in use.

In accordance with one aspect of the invention, in a buoy of the type described, and in which the reel for the anchoring cable has a central shaft and circular end flanges mounted on the shaft, and wherein the reel is mounted within a casing having bearings for the shaft and having end plates disposed inwardly of the bearings, the end plates each have a surface, which may be the internal surface of an aperture, and which closely surrounds the periphery of the adjacent end flange of the reel, the space between the periphery of each end flange and the adjacent surface of an end plate being less than the diameter of the anchoring cable. Also, the inwardly facing surfaces of the end plates and reel flanges are preferably flush. In this way, the anchoring cable is totally enclosed within the reel casing, except for a suitable aperture in the bottom of the casing, and the anchoring cable cannot become snagged on any surfaces, and cannot become caught around the outside of the reel flanges since the space between these flanges and the internal surface of the end plate aperture is smaller than the cable diameter.

The reel flanges are preferably of light and relatively thin material, for example aluminum sheeting, and are preferably stiffened by gussets connecting the internal surfaces of the flanges and the reel shaft. These gusstes may also serve as vanes which act upon water within the reel casing, when the buoy is floating, to brake the rotation of the reel. To allow these vanes to become suitably submerged, the reel casing may be vented to allow water to enter easily when the buoy is floating.

The reel casing may have two coplanar, outwardly extending base flanges, these flanges providing for easy connection to the main body of the buoy by bolts having nuts which can be unscrewed to release the whole reel casing with reel, for maintenance.

The outwardly extending base flanges of the reel casing provide a suitable surface against which a bottom plate may be fitted, and which may be held in position by the same bolts which hold the reel casing to the remainder of the buoy. The bottom plate has an aperture for the anchoring cable, which provides a fair-lead for this cable, and which is preferably elongated in a direction transverse to the reel axis so that in use the anchoring cable tends to stay at one end of the aperture and to inhibit rotation of the buoy. To further stabilize the buoy, the lifeboat mooring line is preferably fixed to a point of attachment at the base of the buoy which is on or close to the longer axis of the elongated bottom plate aperture.

The invention will be more particularly described with reference to the accompanying drawings, in which:

FIG. 1 shows a vertical section through the buoy and its mounting arrangement, as normally held on a vessel, FIG. 1*a* shows a partial sectional elevation through a side of the buoy, FIG. 2 shows an underside view of the reel casing of the buoy, FIG. 3 shows a view on lines 3—3 of FIG. 1, and FIG. 4 shows a perspective view of the reel casing when separated from the buoy, and in the inverted position.

The buoy has an outer body casing 10 of glass fiber reinforced resin which has a domed, approximately hemispherical upper body portion, and a downwardly converging skirt portion. The upper and lower portions are separated by a strong transverse metal plate 12, having outer flanges fixed to the outer casing. The outer casing 10 is centrally recessed at the top to receive a canister 14 containing light and radio beacons, which will be described in more detail below. The lower skirt portion of the outer casing terminates in inwardly directed flanges 10*a*. The lower part of the buoy within the skirt portion of the outer casing, and underneath the plate 12, is recessed to receive the casing 16 of an anchoring cable reel, the form of which casing is best shown in FIGS. 2 and 4. Also, the lower skirt portion of the casing 10 is recessed on opposite sides of the buoy, one of the recesses being shown at 10*b* in FIG. 1*a*, for purposes to be explained. The space between the upper portion of the casing 10 and the transverse plate 12, and the space inside the lower skirt portion of the casing 10 and surrounding the reel casing, is filled with closed-pore foamed synthetic material 18, which is such as to provide buoyancy even if the outer casing is punctured or damaged. The buoyancy is such as to lift the buoy, and all parts including the anchoring cable carried by the buoy, clear of a sinking vessel, and the buoyancy is also sufficient to hold the light at the top of canister 14 well clear of the water level. The color of the buoy will be "International Orange", so that the buoy is readily visible against the sea.

Before describing the buoy in detail, the seating mount on which this rests will be described. This is similar to that described in the aforesaid British patent specification No. 1,416,048. Specifically, this includes a base plate 100 arranged to be permanently secured to the deck of the vessel, and three upstanding columns 102 which support a circular rail 103, positioned at about mid-height of the buoy. The rail 103 is situated at a portion of the buoy which is slightly converging downwardly, and this rail, and the buoy configuration, are such that the buoy will always release from the seating mount if the vessel sinks, even if the vessel simultaneously capsizes. To the plate 100 is fixed an annular support ring 106 shaped to receive the lower rim of the buoy body, with a sealing gasket placed between ring 106 and the buoy. Rubber wedges 108 are placed between the rail 103 and the buoy body to hold the buoy firmly, although in such manner as to allow it to float off as described.

The canister 14 housing the signalling equipment is sealed within the top recess of the buoy body by a Lucite dome 20, screwed onto a gasket surrounding the canister recess. The top of the canister supports a strobe light 22, close to the dome 20, and the lower part of the canister contains a solid state driving circuit for the light 22, as well as a radio transmitter connected to an antenna 24 and which provides a distress and homing signal approved under International regulations. The side of the dome 20 is recessed for switches 26 which may be used for testing the radio or for operating this in an emergency when the buoy is still in position on the vessel. The canister 14 additionally contains batteries for operating the light and radio. The batteries are connected to the light and radio circuits via a magnetic switch 28, which is positioned on the top of the transverse plate 12, for operation by a magnet within rail 103 of the seating mount.

The reel casing 16 is formed partially from aluminum sheeting, and has two end plates 32, two co-planar, outwardly extending base flanges 34, and two rectangular side plates 40. A circular aperture is cut by band saw from each of the end plates 32, the apertures having a diameter just slightly less than the plate width, the cutting of the apertures simultaneously forming two circular discs 36 which provide the end flanges for an anchoring cable reel 37. Thus, upon assembly of the parts as shown, the outer periphery of each of the end flanges 36 of the reel is spaced from the adjacent surfaces of the end plates 32 (i.e. the inwardly facing surfaces of the apertures) by an amount equivalent to the kerf of the band saw, which is less than the diameter of the anchoring cable so that the anchoring cable cannot enter the slot between these parts. The reel casing also includes two end support plates 42 one centrally positioned at each end, and each carrying a journal bearing suitable for receiving the end portion of the reel shaft. One of these support members must of course be removable to allow the reel to be placed in position.

The base flanges 34 provide a locating surface for bottom plate 45. The flanges 34 and the bottom plate are both apertured to receive long bolts 46 extending from the transverse plate 12, through flanges 10*a* of the casing, and terminating in nuts 46*a* which hold the plate 45 against the flanges 34 and also hold the entire reel casing in place with the top plate 30 of the casing adjacent the transverse plate 12. The plate 45 is also centrally apertured at 45*a* for the anchoring cable, aperture 45*a* being elongated so as to have a longer axis transverse to the reel axis for a purpose to be described. The edges of aperture 45*a* have a rounded beading to prevent chafing of the anchoring cable.

The anchoring cable reel 37 comprises essentially the end flanges formed by the discs 36 cut from the end plates of the casing, and a shaft 48 having a reduced diameter central portion to which the anchoring cable 50 is firmly fixed, the end flanges 36 being fixed near to the outer ends of this shaft, with the outer ends of the shaft being carried by bearings in the members 42, and with the inward facing surfaces of flanges 36 flush with those of the end plates 32. In order to support the relatively thin end flanges of the reel, gussets 52 are provided on the interior surfaces of the end flanges, connecting these surfaces to the shaft 48. These gussets, by maintaining the rigidity of the end flanges 36, ensure that the small spaces between the outer edges of these flanges and the end plates 32 is maintained so that the anchoring cable cannot snag in this space. The inwardly facing surfaces of the gussets 52 are provided with a rounded beading so as not to damage the anchoring cable which is wound against these inner surfaces. The gussets 52 may have an additional function of providing braking means to retard rotation of the reel when the buoy is in the water, and for this purpose the reel casing may be vented to atmosphere as by the tube 54. This allows water to enter the reel casing relatively freely, and to engage the gussetts 52 which thus act as vanes or fins in the water, retarding the reel.

The outer end of anchoring cable 50 is fixed to a hydrostatically controlled fixture 110 mounted on the base plate 100, this device being such as to hold the cable firmly in normal conditions and in shallow sinkings but such as to release the cable if the vessel sinks to a depth approaching the length of the anchoring cable.

The reel and reel casing form a sub-assembly which is readily removable from the remainder of the buoy for servicing upon release of the nuts 46*a*.

The recess 10*b* which is disposed on the buoy body at a position radial of the reel, houses a life boat mooring line 58, which is loosely fleeted within this recess and normally retainined in this position by a weather resistant cover 60 which is attached to the buoy body 10 around the margin of the recess by Velcro material. The life boat mooring line is at least 50 feet in length, is buoyant, and is of sufficient strength to hold several life boats in position relative to the buoy even in rough weather. An inner end of the life boat mooring line is permanently attached to the buoy by means of a stainless steel tag line 64 connected to an eye bolt 62 extending through the casing flange 10*a*, and which is disposed close to or on the longer axis of the elongated aperture 45*a*. When the buoy is in use with the mooring line deployed, the anchoring cable will normally ride at the end of aperture 45*a* remote from eye bolt 62 and the combined effect of the mooring line and, anchoring cable will resist rotation of the buoy in the water. The mooring line, being attached to the base of the buoy, does not unduly tilt this when it is subjected to a strong pull.

The outer end of the mooring line carries a light 68 with batteries which automatically become operational on submergence, and the mooring line also preferably has coloured floats spaced therealong to make it more readily visible.

Deployment of the mooring line is arranged to occur automatically after separation of the buoy from the vessel by a predetermined amount, this being achieved by means of a rip cord 72 constituted by a flexible stainless steel wire connecting an upper part of the cover 60 to a reel 74 which is mounted on the plate 100 of the base mounting. The arrangement is such that when the buoy has separated from the vessel by an amount sufficient to clear the vessel rigging, rip cord 72 becomes taut and rips cover 60 away from the recess 10*b*, and on release of the cover 60 the mooring line leaves the recess, which is partially or totally submerged in the water, and streams out from the buoy by wave action.

On the other side of the buoy, to recess 10*b*, a similar recess (not shown) at provided, which is open, and which contains a bottle of calming oil. The stopper of this bottle is attached by a cord to the rail of the seating mount, so as to be removed from the bottle when the buoy leaves the seating mount.

Operation of this buoy is generally similar to that described in the British patent Specification No. 1,416,048 and thus will not be described in detail. The buoy and its seating mount would normally be provided as a package, so that installation would require only the attachment of the base plate to a suitable part of the deck of a vessel, preferably one which is free from overhead rigging so as to minimize the chances of the buoy being snagged in such rigging and being dragged down with the boat. The buoy is preferably also provided with its own launching davit, so that if there is enough time the buoy can be launched by using such davit.

After the buoy has been launched, or has floated free from a sinking vessel, the buoy will remain attached to the vessel by its anchoring cable 50. When the rip cord 72 has been extended to its full length, the mooring line 58 will deploy automatically, providing an easy method of attachment for buoyant equipment such as life rafts and life boats also released from the vessel. Swimmers can also hold onto the mooring line. The radio and light beacons will have been automatically put in operation as soon as the buoy has left the seating mount, and so as to summon assistance to a position where the life boats or life rafts, are held in a safe, head to weather condition by the buoy.

The buoy particularly described above is economical to manufacture, and rugged in service, and is easy to maintain in that both the reel casing carrying the anchoring cable reel, and the electronics canister, can be readily removed from the buoy body for maintenance purposes. The design of the reel casing is such as to positively eliminate any possibility of the anchoring cable becoming snagged as the reel rotates, even if the reel should over-run by reason of its own momentum. Also, the elongated shape of the bottom plate aperture tends to hold the anchoring cable at one end of this aperture, restraining rotation of the buoy in the water such as could cause snarling of the mooring line.

Instead of, or in addition to, using the braking effect of water on the reel gussets, a friction brake may be used. Venting of the reel casing is optional in that the design may allow sufficient water to enter, for braking purposes, without venting.

I claim:

1. A buoy suitable for being carried on the deck of the vessel in a manner permitting release and floatation of the buoy should the vessel sink and including sufficient buoyancy to cause the buoy and parts carried thereby to float free from a sinking vessel, the buoy including an anchoring cable carried by a reel rotatably mounted within the buoy and being connected with the buoy and connectable to the vessel to maintain connection between the sunken vessel and the buoy, wherein the reel for the anchoring cable has a central shaft and circular end flanges mounted on said shaft, and wherein said reel is mounted within a casing having bearings for the shaft and having end plates disposed inwardly of the bearings and having an opening for said anchoring cable to pass out of the casing, said end plates each having an internal surface which closely surrounds the periphery of the adjacent end flange of the reel while allowing free rotation of said flange within said internal surface, the space between the periphery of each end flange and the adjacent surface of an end plate being less than the diameter of the anchoring cable said end plates being spaced on opposite sides of said casing opening and preventing said cable from leaving said casing other than through said opening.

2. A buoy according to claim 1, wherein the internal surface of each end plate is provided by the periphery of a circular aperture in said end plate.

3. A buoy according to claim 1, wherein said reel includes gussets connecting the end flanges and central shaft and disposed on the inside surfaces of said end flanges to stiffen the reel flanges and avoid binding of the anchoring cable.

4. A buoy suitable for being carried on the deck of a vessel in a manner permitting release and floatation of the buoy should the vessel sink and including sufficient buoyancy to cause the buoy and parts carried thereby to float free from a sinking vessel, the buoy including an anchoring cable carried by and secured to a reel rotatably mounted within the buoy, said anchoring cable being connectable to the vessel to maintain connection between the sunken vessel and the buoy, the anchoring cable reel being housed within a casing having a bottom plate, said bottom plate having an aperture for the anchoring cable which is elongated in a direction transverse to the reel axis, thereby avoiding twirling of the buoy following its release; a lifeboat mooring line suitable for mooring of lifeboats or other buoyant equipment to the buoy, an inner end of said mooring line being attached to a point of attachment at the base of the buoy, said point of attachment being close to or on the longer axis of said elongated aperture for the anchoring cable and means for automatic delayed release of the mooring line after separation of the buoy from the vessel.

* * * * *